US010619399B2

(12) United States Patent
McKenna

(10) Patent No.: US 10,619,399 B2
(45) Date of Patent: Apr. 14, 2020

(54) COMBINATION PRESSURE PLATE

(71) Applicant: ARCONIC INC., Pittsburgh, PA (US)

(72) Inventor: Gregory Blake McKenna, Cumming, GA (US)

(73) Assignee: ARCONIC INC., Pittsburgh, PA (US)

( * ) Notice: Subject to any disclaimer, the term of this patent is extended or adjusted under 35 U.S.C. 154(b) by 223 days.

(21) Appl. No.: 15/704,516

(22) Filed: Sep. 14, 2017

(65) Prior Publication Data

US 2019/0078375 A1 Mar. 14, 2019

(51) Int. Cl.

| | |
|---|---|
| ***E06B 1/40*** | (2006.01) |
| ***E04B 2/96*** | (2006.01) |
| ***E06B 1/18*** | (2006.01) |
| ***E06B 3/64*** | (2006.01) |
| ***E06B 3/26*** | (2006.01) |
| ***E06B 3/54*** | (2006.01) |
| ***E06B 1/36*** | (2006.01) |

(52) U.S. Cl.

CPC ..... *E06B 1/40* (2013.01); *E04B 2/96* (2013.01); *E04B 2/967* (2013.01); *E06B 1/18* (2013.01); *E06B 1/366* (2013.01); *E06B 3/26* (2013.01); *E06B 3/5409* (2013.01); *E06B 3/5481* (2013.01); *E06B 3/64* (2013.01)

(58) Field of Classification Search

CPC ... E06B 1/40; E06B 1/366; E06B 1/18; E06B 1/524; E06B 3/5481; E06B 3/5409; E06B 3/64; E06B 3/26; E06B 2003/26312; E06B 2007/145; E06B 3/273; E06B 3/305; E04B 2/967; E04B 2/96; E04B 2/88; E04D 3/08

See application file for complete search history.

(56) References Cited

U.S. PATENT DOCUMENTS

| | | | | |
|---|---|---|---|---|
| 3,734,550 | A * | 5/1973 | Vance | E04B 2/965 403/34 |
| 3,956,863 | A * | 5/1976 | Tiedeken | E06B 3/68 52/204.595 |
| 5,469,683 | A * | 11/1995 | McKenna | E06B 3/273 52/204.591 |
| 5,592,795 | A | 1/1997 | Rinehart et al. | |
| 6,141,923 | A * | 11/2000 | Habicht | E04B 1/943 52/232 |
| 9,683,376 | B2 * | 6/2017 | Zahner | E04F 19/02 |
| 2005/0284046 | A1 * | 12/2005 | Neal | E06B 1/36 52/204.5 |
| 2008/0134597 | A1 | 6/2008 | Rinehart et al. | |
| 2010/0212238 | A1 | 8/2010 | Voegele, Jr. et al. | |

(Continued)

FOREIGN PATENT DOCUMENTS

| | | | |
|---|---|---|---|
| JP | 2005-009222 | A | 1/2005 |
| KR | 10-2014-0015873 | A | 2/2014 |
| WO | 2017/079578 | A1 | 5/2017 |

*Primary Examiner* — Ryan D Kwiecinski
*Assistant Examiner* — Matthew J Gitlin
(74) *Attorney, Agent, or Firm* — Greenberg Traurig, LLP

(57) ABSTRACT

A glazing system for holding glazing units to a frame member has an aluminum pressure plate and a composite plate co-extruded from a plurality of polymers and having a pair of gaskets and a central isolator. A pair of polymer extrusions extend from the isolator and have ledges at the end that embrace and seal against the metal plate. The metal and composite plates are coupled together by a pair of ribs extending from the composite plate into a pair of slots in the metal plate.

17 Claims, 2 Drawing Sheets

(56) References Cited

U.S. PATENT DOCUMENTS

| | | | | |
|---|---|---|---|---|
| 2010/0293882 | A1 | 11/2010 | Labrecque et al. | |
| 2010/0300021 | A1* | 12/2010 | Falk | E04B 2/88 52/235 |
| 2014/0245689 | A1* | 9/2014 | Voegele | E04B 2/967 52/506.08 |

* cited by examiner

COMBINATION PRESSURE PLATE

FIELD

The present invention relates to glazed panel wall constructions, such as curtain walls, storefronts, and the like and more specifically, to a pressure plate for retaining glazing panels in place against a frame in a weather-tight manner.

BACKGROUND

Glazing systems for curtain walls, storefront framing systems, and the like are known wherein a pressure plate retains a glazing panel in place against a frame member, such as a mullion. The mullions are anchored to the building and run between the floor slabs in a window wall application or past the floor slabs in a curtain wall application. Typically, a pair of gaskets is installed within grooves in the pressure plate, which is then fastened to the outer face of the frame member by screws. The gaskets bear against adjacent glazing panels, providing a seal against air and water leakage. A third gasket installed near the center of the pressure plate between the pressure plate and the frame member may also be utilized to provide an additional weather and thermal barrier, e.g., to prevent water and air from migrating from one side of the mullion to the other and providing a thermal barrier between the pressure plate and the mullion. This type of glazing system is labor-intensive to install, requiring multiple separate components to be assembled. Over time, the gaskets may shrink, compromising the integrity of the installation.

A co-extruded pressure plate made from polymer materials is disclosed in U.S. Pat. No. 5,592,795 as an alternative to the more common use of multiple separate gaskets with a metal pressure plate. In order for the pressure plate to be extruded integrally with the gaskets, it must be made of a material that is compatible with the elastomeric gaskets. It is challenging to utilize a compatible combination of currently available polymers for co-extrusion that have sufficient strength through the temperature extremes experienced by buildings for this application. Fiberglass pultrusions have been proposed for pressure plate applications to reduce thermal transfer, but are not as strong and or as easy to fabricate as aluminum pressure plates. Aluminum alloy pressure plates have desirable mechanical and manufacturing properties, despite having greater thermal conductivity. Aluminum provides the integrity and stiffness to maintain clamping pressure during all extremes of weather that are experienced by the exterior of a building. Alternative glazing systems to those presently known therefore remain desirable for different applications and requirements.

SUMMARY

The disclosed subject matter relates to a pressure plate for holding a glazing unit to a frame member, including: an elongated metal plate; and an elongated composite plate formed from a material having a thermal conductivity less than the metal plate, the composite plate and the metal plate aligned and coupled together to form a pressure plate assembly, the pressure plate assembly fastened to the frame member with the composite plate proximate the frame member and the metal plate distal to the frame member, the pressure plate assembly pressing the glazing unit toward the frame member.

In another embodiment, the composite plate has a pair of gaskets and a central isolator attached to and extending longitudinally and parallel to the composite plate along a length thereof.

In another embodiment, the composite plate has at least one rib extending therefrom toward the metal plate and the metal plate has a slot receiving the rib therein to couple the composite plate to the metal plate.

In another embodiment, the composite plate has a pair of ledges extending along opposing side edges of the composite plate, the ledges embracing the metal plate there between.

In another embodiment, further including a cap, the cap attaching to the pressure plate assembly distal to the frame member.

In another embodiment, the frame member has a tongue and the pressure plate assembly has at least one aperture therein and further comprising a threaded fastener, the threaded fastener extending through the at least one aperture and being threadedly received in the tongue, the threaded fastener pushing the pressure plate assembly toward the glazing unit.

In another embodiment, further including a cap with peripheral edges, the cap covering the pressure plate assembly, the pressure plate assembly having a pair of opposed grooves, the opposed grooves receiving corresponding ones of the peripheral edges of the cap.

In another embodiment, the ledges are disposed at an acute angle relative to the composite plate and point in a converging direction.

In another embodiment, each ledge has a land at a tip thereof extending toward the metal plate.

In another embodiment, the ribs have teeth disposed at an orientation that resists withdrawal of the ribs from engagement with the slot.

In another embodiment, the isolator abuts against the tongue dividing the space between adjacent glazing units.

In another embodiment, the composite plate has a pair of extensions extending from the isolator.

In another embodiment, further including a pair of ribs extending from a surface of the composite plate in a perpendicular direction, the ribs running lengthwise along the composite plate parallel to edges of the composite plate and the metal plate has a pair of receivers, the receivers receiving the pair of ribs, the metal plate nesting between the ledges.

In another embodiment, the metal plate has a central offset, the offset receiving a portion of the isolator therein while the pair of extensions abut flat portions of the metal plate on either side of the central offset.

In another embodiment, the central offset has a thicker wall than the flat portions of the metal plate.

In another embodiment, the gaskets and the isolator are adhered to the pair of extensions by an adhesive.

In another embodiment, the gaskets and the isolator are co-extruded with the pair of extensions.

In another embodiment, a glazing system for holding glazing units to a frame member, includes: an elongated metal plate; and an elongated composite plate formed from a plurality of polymers having a thermal conductivity less than the metal plate, the composite plate having a pair of gaskets and a central isolator attached to and extending longitudinally and parallel to the composite plate along a length thereof, the composite plate and the metal plate aligned and coupled together to form a pressure plate assembly, the composite plate having a pair of ribs extending therefrom toward the metal plate and the metal plate having a pair of slots receiving the pair of ribs therein to couple the composite plate to the metal plate, the composite plate having a pair of ledges extending along opposing side edges of the composite plate, the ledges embracing the metal plate there between, wherein the frame member has a tongue and the pressure plate assembly has a plurality of apertures therein and further comprising a plurality of threaded fasteners, the threaded fasteners extending through corresponding ones of the plurality of apertures and being threadedly received in the tongue, the threaded fastener pushing the pressure plate assembly toward the glazing unit, a cap with peripheral edges, the cap covering the pressure plate assembly, the pressure plate assembly having a pair of opposed grooves, the opposed grooves receiving corresponding ones of the peripheral edges of the cap, the pressure plate assembly fastened to the frame member with the composite plate proximate the frame member and the metal plate distal to the frame member, the pressure plate assembly pressing the glazing unit toward the frame member.

In another embodiment, the composite plate has a pair of extensions extending from the isolator and the metal plate has a central offset, the offset receiving a portion of the isolator therein while the pair of extensions abut flat portions of the metal plate on either side of the central offset, the central offset having a thicker wall than the flat portions of the metal plate and wherein the gaskets and the isolator are co-extruded with the pair of extensions.

In another embodiment, the ledges are disposed at an acute angle relative to the composite plate and point in a converging direction, each ledge having a land at a tip thereof extending toward the metal plate, each of the gaskets covering an outside surface of a corresponding one of the ledges, surmounting an upper edge of the ledge and returning in a downward direction on an inside surface of the ledge, including the land, the gaskets sealing between the metal plate and the lands, the isolator abutting against the tongue dividing the space between adjacent glazing units.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

Figure 1:
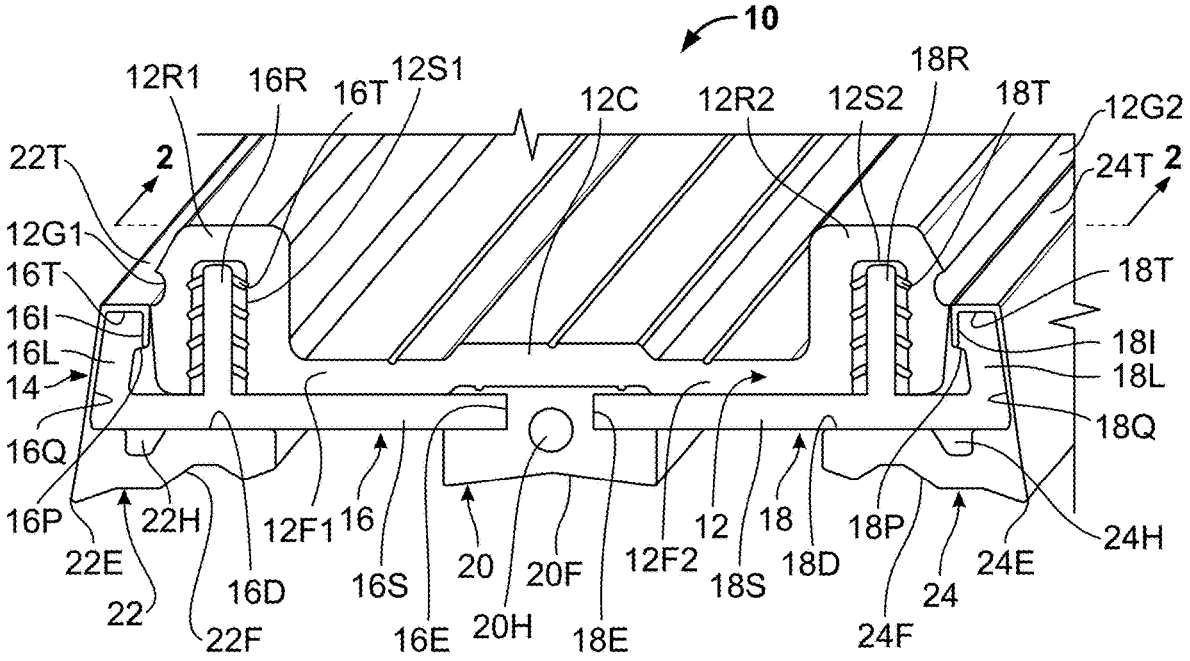
FIG. 1 is a perspective view of a fragment of a pressure plate assembly in accordance with an embodiment of the present disclosure.
Figure 2:
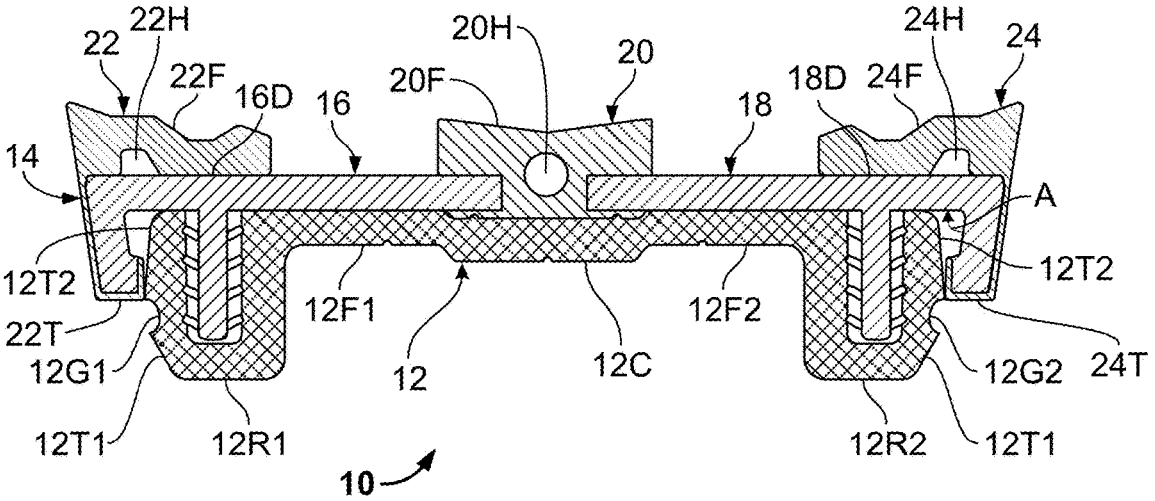
FIG. 2 is a cross-sectional view of the assembly of FIG. 1.

FIGS. 1 and 2 show a pressure plate assembly 10 in accordance with an embodiment of the present disclosure and which includes a metal plate 12 and a composite plate 14. The pressure plate assembly 10 is an elongated member that extends along the edges of glazing panels 30, 32 (FIG. 3), e.g., in the vertical, or horizontal directions, parallel to the mullions. The glazing panels 30, 32 can be other than rectilinear, e.g., the pressure plate assembly 10 may be at an oblique angle relative to the horizontal or vertical. The metal plate 12 may be formed, e.g., extruded from an aluminum alloy, e.g., a 6063 or 6061 aluminum alloy. The composite plate 14 has a pair of extensions 16, 18 that may be made, e.g., extruded, from a rigid polymer, such as, glass filled polypropylene, nylon or polyamide. The extensions 16, 18 extend laterally (in the width direction) from a central thermal isolator 20 that may be made, e.g., extruded, from a flexible polymer, such as thermal plastic elastomer (TPE). The extensions 16, 18 and the isolator 20 are elongated and capable of running parallel to the metal plate 12 when it is positioned over the edge of glazing panels 30, 32 and running the length (or width) of the panels 30, 32. As depicted, there are two separate extensions 16, 18 that attach to the isolator 20. In an alternative embodiment, the extensions 16, 18 and/or isolator 20 may be part of a single extrusion that extends across the entire width of the composite plate 14. The extensions 16, 18 each have a straight portion 16S, 18S, a ledge 16L, 18L and a rib 16R, 18R with retainer teeth 16T, 18T, respectively. The ribs 16R, 18R are received in slots 12S1, 12S2 provided in receivers 12R1, 12R2 of the metal plate 12. The retainer teeth 16T, 18T have an orientation allowing insertion, but resisting withdrawal from the slots 12S1, 12S2. The receivers 12R1, 12R2 have a U-shaped cross-sectional shape and have outer grooves 12G1, 12G2 for receiving the gripping edges of a cap 44 as described below in reference to FIG. 3. The receivers 12R1, 12R2 have rounded edges and tapered surfaces 12T1, 12T2 to facilitate slipping the cap 44 and ledges 16L, 18L thereover.

Figure 3:
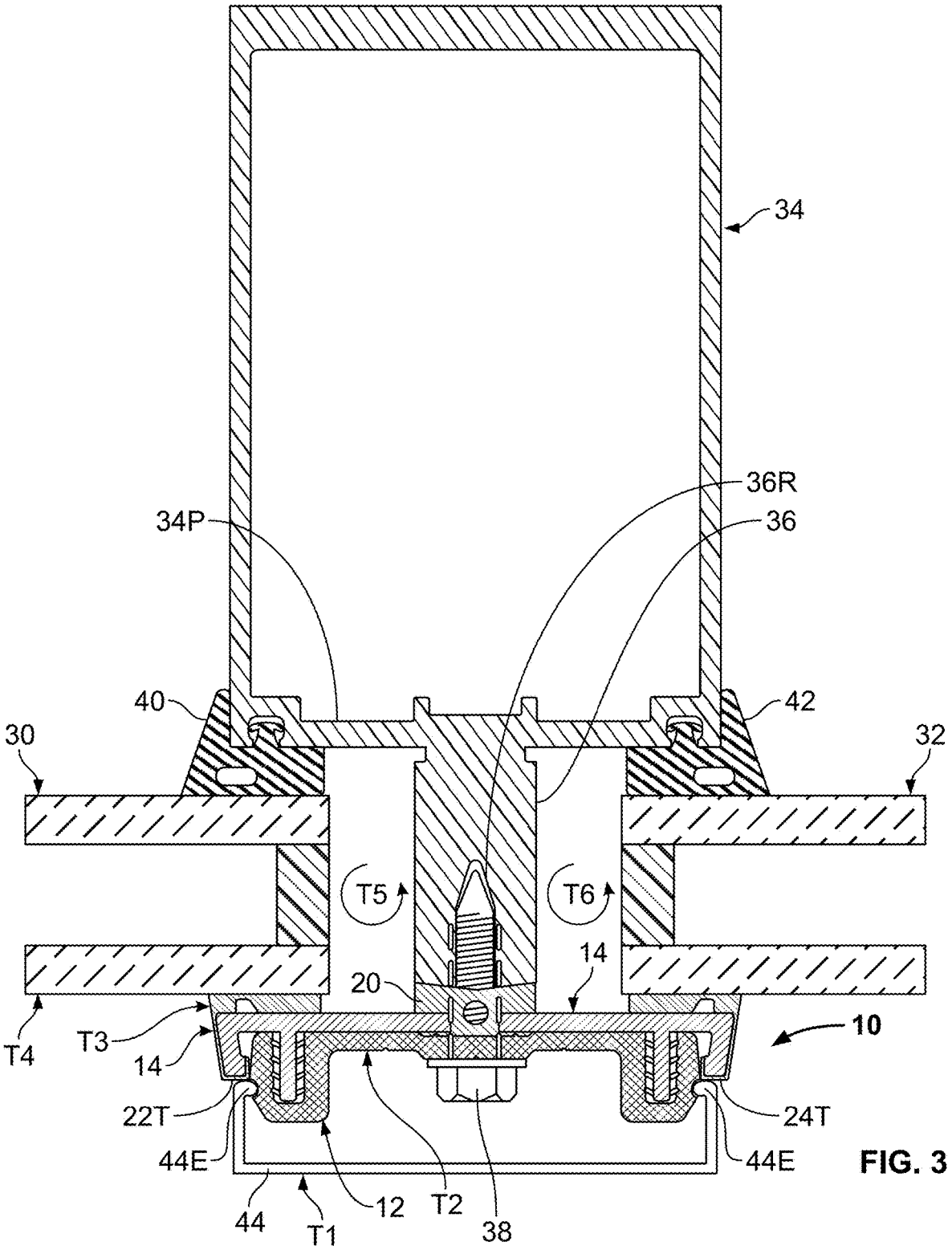
FIG. 3 is a cross-section view of the assembly of FIGS. 1 and 2 holding glazing panels against a frame member.

Gaskets 22, 24 made from an elastomeric material such as TPE, flexible polyvinyl chloride, DuPont Alcryn®, or other suitable elastomer are formed, e.g., co-extruded, on the extensions 16, 18 proximate the ledges 16L, 18L on surfaces 16D, 18D distal to the ribs 16R, 18R, respectively. In another embodiment, the gaskets 22, 24 may be separately formed and then adhered to the extensions 16, 18 by an adhesive or thermal welding. The gaskets 22, 24 have varying thickness over the width thereof and faces 22F, 24F permitting increased contact area with a glazing panel (FIG. 3) in response to increased pressure, preferentially starting to seal at the outer edges 22E, 24E and then forming a wider sealing area in an inward direction (toward the central isolator 20 in the width direction). Hollows 22H and 24H in the gaskets 22, 24 make them more compliant and responsive to increased pressure. In a similar way, the face 20F of the thermal isolator 20 has a V-shaped configuration and a hollow 20H that makes the thermal isolator 20 more compliant when pressed against a frame member 34 (FIG. 3). The gaskets 22, 24 extend along an outer surface 16Q, 18Q of the ledges 16L, 18L, surmount an end 16T, 18T of the ledges and extend along an upper inner surface 161, 181 of the ledges 16L, 18L. The ledges 16L, 18L have a land (prominence) 16P, 18P at the ends thereof. The ledges 16L, 18L are disposed at an angle A relative to the straight portions 16S, 18S and converge inwardly. When the ribs 16R 18R are pressed fully into the slots 12S1, 12S2, terminal surfaces 22T, 24T of the gaskets 22, 24 are substantially parallel to and proximate to the grooves 12G1, 12G2.

The metal plate 12 has a central offset 12C between flat portions 12F1, 12F2. The offset 12C may have a greater wall thickness than the flat portions 12F1, 12F2 to provide greater rigidity for the metal plate 12. The offset 12C also accommodates a portion of the thermal isolator 20, such that the body of the thermal isolator 20 can accommodate the inner ends 16E, 18E of the extensions 16, 18 therein, while the extensions 16, 18 abut against the flat portions 12F1, 12F2 of the metal plate 12. The registration of the offset 12C with the thermal isolator 20, the ribs 16R, 18R with the slots 12S1, 12S2 and the ledges 16L and 18L embracing the metal plate 12 proximate the receivers 12R1, 12R2, all contribute to establishing a pre-determined relative orientation between the metal plate 12 and the composite plate 14.

The composite plate 14 may be pre-assembled in a manufacturing facility rather than at the job site. Similarly, the composite plate 14 and the metal plate 12 may be assembled to form the pressure plate assembly 10 in a manufacturing facility. Alternatively, the composite plate 14 and the metal plate 12 may be assembled to form the pressure plate assembly 10 in the field, since assembly may be accomplished by a press-fit. In one alternative, the composite plate 14 and the metal plate 12 may be adhered to one another by an adhesive. The parts of the composite plate 14, such as a extensions 16, 18, the thermal insulator 20 and the gaskets 22, 24 may be produced separately and then assembled and adhered to one another using adhesives or thermal (plastic) welding. In another alternative, the parts of the composite plate 14, such as extensions 16, 18, the thermal insulator 20 and the gaskets 22, 24 may be produced and adhered to one another simultaneously by co-extrusion. Co-extrusion techniques are known to those skilled in the art wherein pellets of the different polymers, e.g. flexible polyvinyl chloride and glass-reinforced polyvinyl chloride, are placed in separate screw presses, heated, and forced as molten material through separate cavities of an extrusion press. The different polymers are forced through different ports of an extrusion die and brought together as they exit the die to form a unitary extrusion (co-extrusion).

In another alternative, the composite plate 14 may be produced by additive manufacturing (3D printing) methods.

FIG. 3 is a cross-sectional view of the pressure plate assembly 10 holding glazing panels 30, 32 against a frame member 34, such as a mullion. An attachment tongue 36 with a race 36R (slot for accommodating fasteners) extends from front plate 34P of the frame member 34. The fastener, e.g., a threaded bolt 38 retains the pressure plate assembly 10 and presses it against the glazing panels 30, 32 when the bolt 38 is tightened. Apertures extend through the pressure plate assembly 10 (including through the metal plate 12, the composite plate 14 and the isolator 20) at intervals along its length, e.g., every 3 inches, to accommodate a plurality of bolts 38. In the instance where the composite plate 14 and the metal plate 12 are matched in length, the holes in the composite plate 14 (in the isolator) may be pre-formed such that when terminal edges of the metal plate 12 and the composite plate 14 are aligned and they are pressed together to assemble the plate assembly 10, the holes for the fasteners will align. In another alternative, the holes through the composite plate 14 may be made, e.g., by drilling after the metal plate 12 and the composite plate 14 are assembled together. In a further alternative, the holes through the composite plate (through the isolator 20) can be made when the fastener 38 is inserted, i.e., by the fastener 38 making its own hole by piercing through the isolator 20 when the pressure plate assembly 10 is installed. Inner gaskets 40, 42 intermediate between the glazing panels 30, 32 and the frame member 34, provide a weather seal, thermal insulation and cushioning of the glazing panels 30, 32.

A cap 44 may be placed over the pressure plate assembly 10 to provide a finished look and improve thermal and weather resistance. The cap 44 is made from a material, such as an aluminum alloy or a polymer that has a degree of elasticity sufficient to allow the cap 44 to deform, permitting the edges 44E to slip over the metal plate 12, and enter and grip the grooves 12G1, 12G2. In one embodiment, the gasket surfaces 22T and 24T may seal against the edges 44E of the cap 44 to reduce air and water intrusion into the space under the cap 44, providing a weather and thermal barrier. The pressure plate assembly 10 aids in reducing thermal transfer and weather infiltration through and around the cap 44 as indicated diagrammatically by arrow T1, through the pressure plate assembly 10, (T2), between the glazing units 30, 32 and the pressure plate assembly 10 (T3), through the glazing units 30, 32 and pressure plate assembly 10 (T4) and by convection on either side of the tongue 36 (T5 and T6).

An aspect of the present disclosure is to produce a pressure plate assembly 10 that combines the beneficial attributes of a aluminum pressure plate (metal plate 12) with those of a co-extruded polymer pressure plate (composite plate 14), which features the gaskets 22, 24 and the central thermal isolator 20. The metal plate 12 provides the structural support associated with traditional pressure plates, while the composite plate 14 provides the desired sealing and thermal isolation properties, while simultaneously allowing easy and reliable installation. The composite plate 14 (with lower thermal conductivity) is integrated into a single unit (is unitized), providing a continuous, uninterrupted thermal barrier across its width and across the width of the metal plate 12, which is embraced by the ledges 16L, 18L. When the composite plate 14 is assembled to the metal plate 12 and occupies a position between the metal plate 12 and the frame member 34, it reduces thermal transfer there between. The composite plate 14 insures proper positioning of the isolator 20 and gaskets 22, 24 when first installed, firmly holding same in position relative to the metal plate 12. The integral composite plate 14 also resists shrinkage and movement of the isolator 20 and gaskets 22, 24 relative to the extensions 16, 18 and the metal plate 12 after installation, thereby preserving weather-tightness and extending the useful life of the glazing system. The reduction in the number of parts required to assemble the glazing system simplifies assembly and reduces the inventory storage and processing required for a system with a greater number of parts, as well as, the staging required in preparing for an installation.

It will be understood that the embodiments described herein are merely exemplary and that a person skilled in the art may make many variations and modifications without departing from the spirit and scope of the claimed subject matter. All such variations and modifications are intended to be included within the scope of the appended claims.

I claim:

1. A pressure plate for holding a glazing unit to a frame member, comprising:

(A) an elongated metal plate with a pair of receivers with a U-shaped cross-sectional shape disposed along opposing edges of the metal plate;

(B) an elongated composite plate formed from a material having a thermal conductivity less than the metal plate and having a pair of elongated ribs extending from a surface thereof, each of the pair of ribs inserting into one of the pair of receivers, the composite plate and the metal plate aligned and coupled together to form a pressure plate assembly; and (C) a pair of gaskets disposed on a surface of the composite plate distal to the metal plate, the pair of gaskets aligning with the pair of receivers.

2. The pressure plate of claim 1, wherein the composite plate has a central isolator attached to and extending longitudinally and parallel to the composite plate along a length thereof.

3. The pressure plate of claim 2, wherein the isolator divides a space between adjacent glazing units.

4. The pressure plate of claim 2, wherein the composite plate has a pair of extensions extending from the isolator.

5. The pressure plate of claim 4, wherein the gaskets and the isolator are adhered to the pair of extensions by an adhesive.

6. The pressure plate of claim 4, wherein the gaskets and the isolator are co-extruded with the pair of extensions.

7. The pressure plate of claim 1, wherein the composite plate has a pair of ledges extending along opposing side edges of the composite plate, the ledges embracing the metal plate there between.

8. The pressure plate of claim 7, wherein the ledges are disposed at an acute angle relative to the composite plate and point in a converging direction.

9. The pressure plate of claim 8, wherein each ledge has a land at a tip thereof extending toward the metal plate.

10. The pressure plate of claim 1, further comprising a cap, the cap attaching to the pressure plate assembly distal to the frame member.

11. The pressure plate of claim 10, wherein the cap has peripheral edges, the cap covering the metal plate, the metal plate having a pair of opposed grooves on the opposed receivers, the opposed grooves receiving corresponding ones of the peripheral edges of the cap.

12. The pressure plate of claim 1, wherein the ribs have teeth disposed at an orientation that resists withdrawal of the ribs from engagement with the slot.

13. A pressure plate for holding a glazing unit to a frame member, comprising:

(A) an elongated metal plate; and (B) an elongated composite plate formed from a material having a thermal conductivity less than the metal plate, the composite plate and the metal plate aligned and coupled together to form a pressure plate assembly, the pressure plate assembly fastened to the frame member with the composite plate proximate the frame member and the metal plate distal to the frame member, the pressure plate assembly pressing the glazing unit toward the frame member, wherein the composite plate has a pair of gaskets and a central isolator attached to and extending longitudinally and parallel to the composite plate along a length thereof, wherein the composite plate has a pair of extensions extending from the isolator, wherein the composite plate has a pair of ledges extending along opposing side edges of the composite plate, the ledges embracing the metal plate there between, further comprising a pair of ribs extending from a surface of the composite plate in a perpendicular direction, the ribs running lengthwise along the composite plate parallel to edges of the composite plate and the metal plate has a pair of receivers, the receivers receiving the pair of ribs, the metal plate nesting between the ledges, wherein the metal plate has a central offset, the offset receiving a portion of the isolator therein while the pair of extensions abut flat portions of the metal plate on either side of the central offset.

14. The pressure plate of claim 13, wherein the central offset has a thicker wall than the flat portions of the metal plate.

15. A glazing system for holding a glazing unit, comprising:

(A) a frame member;

(B) an elongated metal plate; and (C) an elongated composite plate formed from a plurality of polymers having a thermal conductivity less than the metal plate, the composite plate having a pair of gaskets and a central isolator attached to and extending longitudinally and parallel to the composite plate along a length thereof, the composite plate and the metal plate aligned and coupled together to form a pressure plate assembly, the composite plate having a pair of ribs extending therefrom toward the metal plate and the metal plate having a pair of slots receiving the pair of ribs therein to couple the composite plate to the metal plate, the composite plate having a pair of ledges extending along opposing side edges of the composite plate, the ledges embracing the metal plate there between, wherein the frame member has a tongue and the pressure plate assembly has a plurality of apertures therein and further comprising a plurality of threaded fasteners, the threaded fasteners extending through corresponding ones of the plurality of apertures and being threadedly received in the tongue, the threaded fastener pushing the pressure plate assembly toward the glazing unit, a cap with peripheral edges, the cap covering the pressure plate assembly, the pressure plate assembly having a pair of opposed grooves, the opposed grooves receiving corresponding ones of the peripheral edges of the cap, the pressure plate assembly fastened to the frame member with the composite plate proximate the frame member and the metal plate distal to the frame member, the pressure plate assembly pressing the glazing unit toward the frame member.

16. The glazing system of claim 15, wherein the composite plate has a pair of extensions extending from the isolator and the metal plate has a central offset, the offset receiving a portion of the isolator therein while the pair of extensions abut flat portions of the metal plate on either side of the central offset, the central offset having a thicker wall than the flat portions of the metal plate and wherein the gaskets and the isolator are co-extruded with the pair of extensions.

17. The glazing system of claim 16, wherein the ledges are disposed at an acute angle relative to the composite plate and point in a converging direction, each ledge having a land at a tip thereof extending toward the metal plate, each of the gaskets covering an outside surface of a corresponding one of the ledges, surmounting an upper edge of the ledge and returning in a downward direction on an inside surface of the ledge, including the land, the gaskets sealing between the metal plate and the lands, the isolator abutting against the tongue dividing the space between adjacent glazing units.

* * * * *